US008264185B2

(12) United States Patent
Yadidya

(10) Patent No.: US 8,264,185 B2
(45) Date of Patent: Sep. 11, 2012

(54) APPARATUS FOR ROTATING SHUTTER'S AXIS

(76) Inventor: Asif Yadidya, Kiriat Ata (IL)

( * ) Notice: Subject to any disclaimer, the term of this patent is extended or adjusted under 35 U.S.C. 154(b) by 332 days.

(21) Appl. No.: 12/529,986

(22) PCT Filed: Mar. 6, 2008

(86) PCT No.: PCT/IL2008/000299

§ 371 (c)(1),
(2), (4) Date: Jan. 4, 2010

(87) PCT Pub. No.: WO2008/107894

PCT Pub. Date: Sep. 12, 2008

(65) Prior Publication Data

US 2011/0022233 A1 Jan. 27, 2011

(30) Foreign Application Priority Data

Mar. 6, 2007 (IL) ..... 181757

(51) Int. Cl.
*A47H 5/02* (2006.01)

(52) U.S. Cl. ..... 318/475; 318/15; 318/286; 318/468

(58) Field of Classification Search ..... 318/264–266, 318/272, 275, 277, 282, 286, 466–469, 475, 318/652, 653, 9, 14, 15
See application file for complete search history.

(56) References Cited

U.S. PATENT DOCUMENTS 3,661,448 A * 5/1972 Thiele et al. ..... 352/91 S
5,467,808 A * 11/1995 Bell ..... 160/168.1 P
5,860,463 A * 1/1999 Lassen ..... 160/84.02
6,619,365 B1 * 9/2003 Wen et al. ..... 160/168.1 P

* cited by examiner

*Primary Examiner* — Bentsu Ro
(74) *Attorney, Agent, or Firm* — Holtz, Holtz, Goodman & Chick, PC

(57) ABSTRACT

An apparatus for electrically rotating a shutter's axis in order to fold and unfold the shutter includes an electrical motor; a gear that is driven by the motor; and a rotatable adapting unit or a flange to which the shutter's axis is connected. The rotatable adapting unit is connected to the gear. The apparatus may also include two switches, each switch stopping the motor when depressed, located at both ends of a rail, and wherein an element is installed in the rail capable to move along the rail and the element depresses one of the switches when arriving to any end of the rail. A circular plate with a spiral tunnel grooved on its surface is joined to the rotatable adapting unit or flange; and a pin is installed on the element and is settled in the grooved tunnel, moving the element along the rail according to the rotation of the plate.

10 Claims, 3 Drawing Sheets

APPARATUS FOR ROTATING SHUTTER'S AXIS

This application is a U.S. National Phase Application under 35 USC 371 of International Application PCT/IL2008/000299 filed Mar. 6, 2008.

FIELD OF THE INVENTION

The present invention relates to window shutters, particularly to shutters that are folded and unfolded electrically.

BACKGROUND OF THE INVENTION

Window shutters have been used for many years, either for shading purposes, hiding, or both.

Some shutters are folded and unfolded electrically by using a motor. This motor is a cylinder shaped motor that usually inserted into the shutter axis, which is usually has a cannular hexagonal (or any other shape) profile.

The cylinder shaped motor has an external surface that capable to rotate while the inside body is stop and by this way the motor is rotating the shutter axis.

The known shutter motors are expensive and very difficult to maintenance. The present invention provides a simple, inexpensive and easy to maintain apparatus for rotating shutter's axis, regardless its shape.

SUMMARY OF THE INVENTION

The present invention is an apparatus for electrically rotating a shutter's axis.

According to preferred embodiment of the present invention it is provided an apparatus for electrically rotating a shutter's axis in order to fold and unfold said shutter, the apparatus is comprised of:

- an electrical motor;
- a gear that is driven by the motor; and
- a rotate-able adapting unit or a flange to which the shutter's axis is connected, wherein the rotate-able adapting unit is connected to the gear.

According to another preferred embodiment the apparatus is provided, wherein the apparatus further includes:

- two switches, each of these switches stops the motor when depressed, located in both ends of a rail, wherein an element is installed in the rail capable to move along the rail and the element depress one of these switches when arriving to any end of the rail;
- a circular plate with a spiral tunnel grooved on its surface, wherein the circular plate is joined to the rotate-able adapting unit or flange;
- a pin installed on the element and is settled in the grooved tunnel, moving the element along the rail according to the rotation of the plate.

According to another preferred embodiment the apparatus is provided, wherein the two switches are adjustable along the rail in order to stops the motor in predetermined shutter's positions.

According to another preferred embodiment the apparatus is provided, wherein the plate is one of said gear cogwheel.

According to another preferred embodiment the apparatus is provided, wherein the apparatus further includes:

- a revolving counter for counting the rotate-able adapting unit revolves or the motor revolves or the adapting unit revolves; and
- a stopper that stops the motor according to a predetermined clockwise or anticlockwise revolves number that is received from the revolving counter.

According to another preferred embodiment the apparatus is provided, wherein the revolving counter is a mechanical apparatus that mechanically stops the motor in a predetermined position.

According to another preferred embodiment the apparatus is provided, wherein the apparatus further includes a controller operative for:

- receiving commands to activate the motor, clockwise or anticlockwise;
- commands the motor to rotate according to the received command;
- receiving information from the revolving counter; and
- stops the motor according a predetermined number of revolves.

According to another preferred embodiment the apparatus is provided, wherein the controller is further operative for:

- commands the stopper to break the motor or the adapting unit while the motor is in a stop position and to release the motor or the adapting unit for a new movement.

According to another preferred embodiment the apparatus is provided, wherein the controller is capable to be programmed to stop the motor in a several predetermined positions—in relation to a reference position—in order to fold or unfold the shutter to several predetermined positions.

According to another preferred embodiment the apparatus is provided, wherein the apparatus further includes a receiver that is connected to the controller enables to command and program the controller by using a remote-control.

According to yet another preferred embodiment the apparatus is provided, wherein the revolving counter is integrated in the controller.

BRIEF DESCRIPTION OF THE FIGURES

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the figures.

DESCRIPTION OF THE PREFERRED EMBODIMENT

Figure 1:
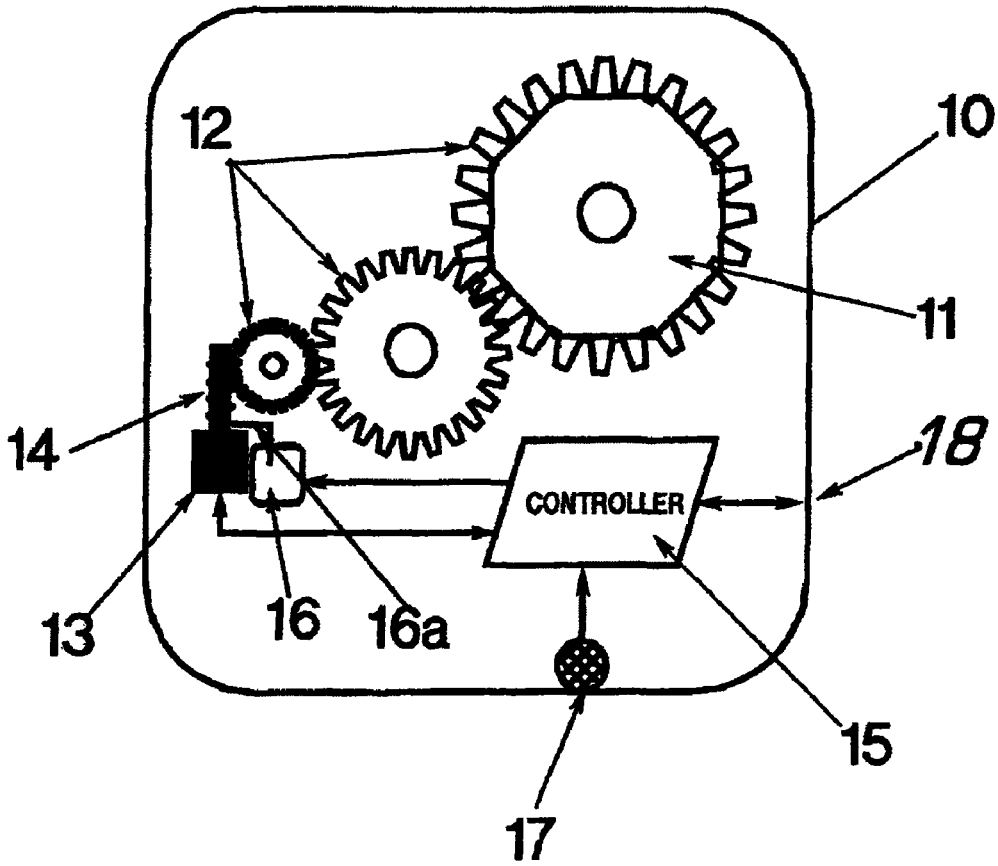
FIG. 1 illustrates the apparatus for electrically rotating shutter's axis.

The present invention is an apparatus for electrically rotating a shutter's axis.

The principles and operation of the apparatus for electrically rotating a shutter's axis, according to the present invention, may be better understood with reference to the drawing and the accompanying description.

The present invention is an apparatus for electrically rotating a shutter's axis roller shutter, which is designed to fold and unfold a shutter by rotating its axis with the capability to stop in any position, to stop in preset positions and capable to be command directly or by a remote-control.

Referring now to the drawing, FIG. 1 illustrates the apparatus for electrically rotating shutter's axis. The apparatus is built in housing 10 and capable to be connected to a shutter axis via a flange 11, which is part the main cogwheel of the gear 12. A motor 13 with a spiral thread rotor 14 is located in the housing 10 together with the gear 12 and the motor 13 capable to rotate the flange 11 via the gear 12. Near the motor 13 a mechanical stopper 16 is installed that is capable to stop the motor 13 by its arm 16*a*. This mechanical stopper 16 is used—inter alia—for preventing the shutter's slipping down that can be caused by the shutter's weight. The movement and stop of the motor 13—and accordingly the movement and stop of the shutter—is controlled by a controller 15 that capable to be programmed to move and stop in predetermined positions. The controller commands the motor according to operation commands that received via a line command 18. Optionally, a sensor 17 can be installed in order to command and/or programming the controller 15 by using a remote-control device (not shown).

In order to recognize the shutter's location the apparatus includes a revolving counter, which can be a mechanical counter with mechanical stopping equipment or an electronic one that is integrated in the controller 15. The electronic revolving counter (not shown) is part of the controller 15 and receives revolving information from the motor 13. In predetermined positions, the controller 15 can stop the rotation by commanding the motor 13 or by using the mechanical stopper 16 or both.

Figure 2:
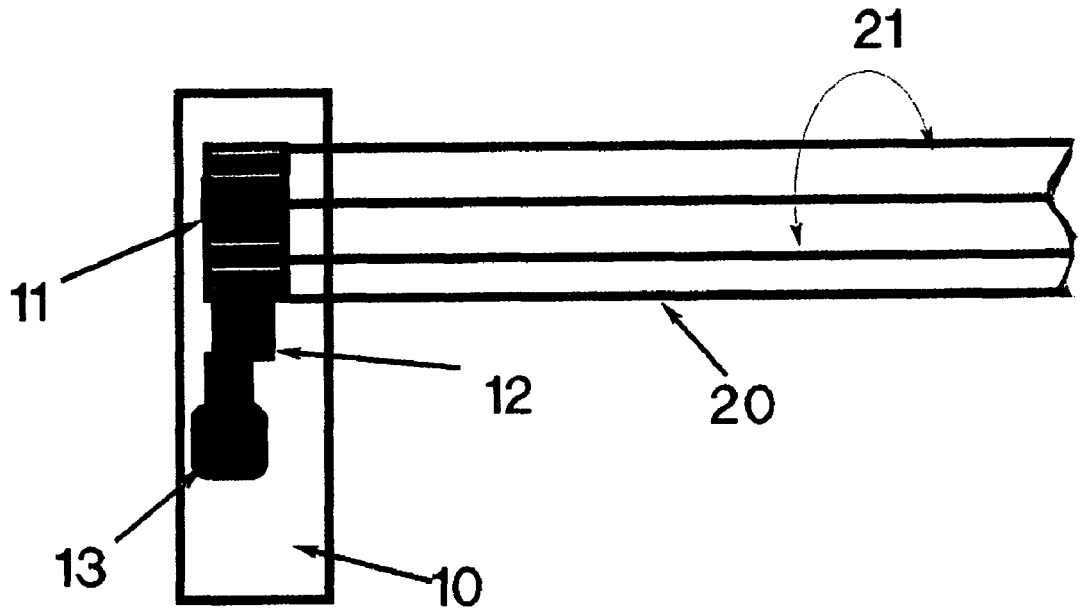
FIG. 2 illustrates the way in which the apparatus is installed on the shutter's axis.

FIG. 2 illustrates the way in which the apparatus is installed on the shutter's axis. The shutter's axis 20—usually hexagonal—is capable to rotate clockwise or anticlockwise in order to fold or unfold the shutter. The shutter's axis is connected to the flung 11 of the apparatus 10 and is rotate-able by the motor 13 via the gear 12.

Figure 3:
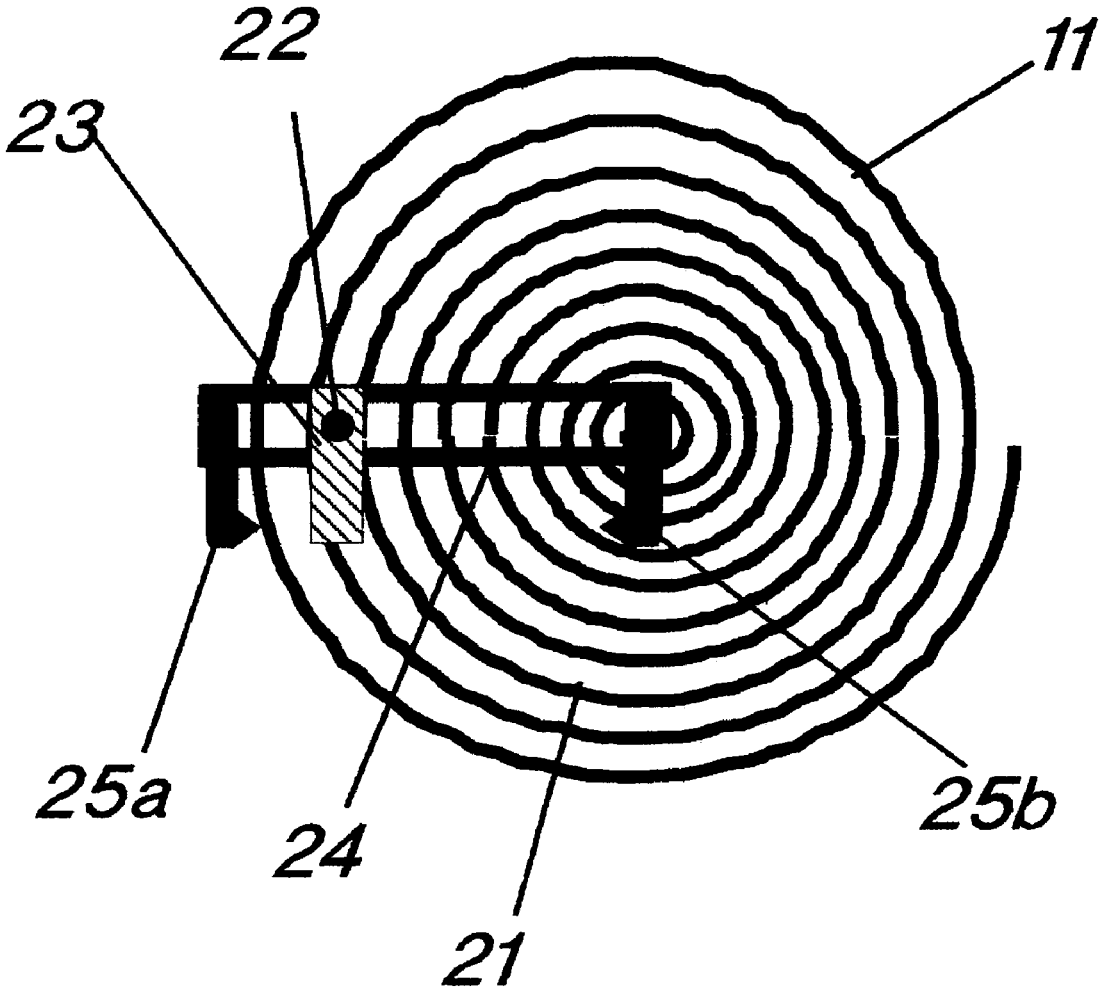
FIG. 3 illustrates an embodiment of mechanical stopper that stops the shutter in predetermined positions.

FIG. 3 illustrates an embodiment of mechanical stopper that stops the shutter in predetermined positions. On the back side of the flange 11 a spiral tunnel 21 is grooved. An element 23 has a pin 22 that is settled in the grooved tunnel 21 and installed on a rail 24. In this way, when the flange 11 is rotating and the rail 24 prevents the circulation of the element 23, the pin 22 leads the element 23 along the rail 24—according to the circulation of the flange 11—right or left according to the turn's direction of the flange 11. The element 23, on arrival to the rail's 24 end, depress one of the two switches or micro switches 25*a* and 25*b* that are installed on both end of the rail 24, each switch 25*a* or 25*b* stops the motor and the shutter with it. The location of each switch 25*a* and 25*b* on the rail 24 is adjustable enable to predetermine the stopping positions of the shutter.

Although the invention has been described in conjunction with specific embodiments thereof, it is evident that many alternatives, modifications and variations will be apparent to those skilled in the art, accordingly, it is intended to embrace all such alternatives, modifications and variations that fall within the spirit and broad scope of the appended claims.

What is claimed is:

1. An apparatus for electrically rotating a shutter's axis in order to fold and unfold said shutter, said apparatus comprising:

an electrical motor;

a gear that is driven by said motor;

one of a rotatable adapting unit and a flange to which said shutter's axis is connected, wherein said rotatable adapting unit is connected to said gear;

two switches provided at both ends of a rail, each of said switches stopping said motor when depressed, wherein an element is installed in said rail which is movable along said rail, said element depressing one of said switches when arriving to an end of said rail;

a circular plate with a spiral tunnel grooved into its surface, wherein said circular plate is joined to one of said rotatable adapting unit and said flange; and a pin installed on said element and settled in said grooved spiral tunnel, said pin moving said element along said rail according to a rotation of said plate.

2. The apparatus according to claim 1, wherein said two switches are adjustable along said rail in order to stop said motor at predetermined positions.

3. The apparatus according to claim 1, wherein said plate is a cogwheel of said gear.

4. An apparatus for electrically rotating a shutter's axis in order to fold and unfold said shutter, said apparatus comprising:

an electrical motor;

a gear that is driven by said motor;

one of a rotatable adapting unit and a flange to which said shutter's axis is connected, wherein said rotatable adapting unit is connected to said gear;

a revolving counter for counting revolutions of one of said rotatable adapting unit and said motor; and a stopper that stops said motor according to a predetermined number of clockwise or anticlockwise revolutions received from said revolving counter.

5. The apparatus according to claim 4, wherein said revolving counter comprises a mechanical apparatus that mechanically stops said motor at a predetermined position.

6. The apparatus according to claim 4, further comprising a controller which controls functions comprising:

receiving commands to activate said motor, clockwise or anticlockwise;

commanding said motor to rotate according to said received command;

receiving information from said revolving counter; and stopping said motor according to a predetermined number of revolutions.

7. The apparatus according to claim 6, wherein said controller further controls commanding said stopper to brake said motor or said adapting unit while the motor is in a stop position and to release said motor or said adapting unit for a new movement.

8. The apparatus according to claim 6, wherein said controller is programmable to stop said motor at a plurality of predetermined positions with respect to a reference position, in order to fold or unfold the shutter to a plurality of predetermined positions.

9. The apparatus according to claim 6, further comprising a receiver that is connected to said controller and enables commanding and programming of said controller by using a remote-control.

10. The apparatus according to claim 6, wherein said revolving counter is integrated in said controller.

* * * * *